US011945077B1

(12) United States Patent
Kyoshima et al.

(10) Patent No.: US 11,945,077 B1
(45) Date of Patent: Apr. 2, 2024

(54) SYNTHETIC GRINDSTONE, SYNTHETIC GRINDSTONE ASSEMBLY, AND MANUFACTURING METHOD OF SYNTHETIC GRINDSTONE

(71) Applicant: TOKYO DIAMOND TOOLS MFG. CO., LTD., Tokyo (JP)

(72) Inventors: Kai Kyoshima, Tokyo (JP); Takeshi Yagi, Tokyo (JP)

(73) Assignee: TOKYO DIAMOND TOOLS MFG. CO., LTD., Tokyo (JP)

( * ) Notice: Subject to any disclaimer, the term of this patent is extended or adjusted under 35 U.S.C. 154(b) by 0 days.

(21) Appl. No.: 18/318,979

(22) Filed: May 17, 2023

(30) Foreign Application Priority Data

Sep. 26, 2022 (JP) ..... 2022-152940

(51) Int. Cl.
*B24D 5/02* (2006.01)
*B24D 18/00* (2006.01)

(52) U.S. Cl.
CPC ..... *B24D 5/02* (2013.01); *B24D 18/0009* (2013.01)

(58) Field of Classification Search
CPC .... B24B 3/02; B24B 3/04; B24B 3/14; B24B 3/16; B24B 3/18; B24B 3/34; B24B 3/342; B24B 3/346; B24B 37/11; B24B 37/12; B24B 37/14; B24D 7/02; B24D 18/0009
See application file for complete search history.

(56) References Cited

U.S. PATENT DOCUMENTS

| | | | | |
|---|---|---|---|---|
| 6,383,238 | B1 * | 5/2002 | Takahashi | B24D 3/28 51/296 |
| 6,679,758 | B2 | 1/2004 | Bright et al. | |
| 7,077,723 | B2 | 7/2006 | Bright et al. | |
| 7,422,513 | B2 | 9/2008 | Bright et al. | |
| 2003/0194947 | A1 | 10/2003 | Bright et al. | |
| 2004/0072505 | A1 * | 4/2004 | Matsui | B24D 3/28 451/526 |
| 2005/0101225 | A1 | 5/2005 | Bright et al. | |
| 2006/0160476 | A1 | 7/2006 | Bright et al. | |
| 2008/0156657 | A1 * | 7/2008 | Butterfield | B23H 5/08 205/662 |

(Continued)

FOREIGN PATENT DOCUMENTS

| | | | |
|---|---|---|---|
| JP | 2004-087912 | A | 3/2004 |
| JP | WO2005/072912 | A1 | 8/2005 |

(Continued)

OTHER PUBLICATIONS

Japanese Office Action dated Oct. 25, 2022 received in 2022-152940.

(Continued)

*Primary Examiner* — Joel D Crandall
(74) *Attorney, Agent, or Firm* — Scully, Scott, Murphy & Presser, P.C.

(57) ABSTRACT

A synthetic grindstone for performing surface processing, includes: abrasive grains; binder made of a thermosetting resin material and holding the abrasive grains in a dispersed state; and filler including at least one of first filler, second filler, and third filler. The first filler has a larger average particle diameter than the abrasive grains. The second filler has electrical conductivity. The third filler is harder than a workpiece. The filler is disposed in a state of being dispersed in the binder.

6 Claims, 2 Drawing Sheets

(56) References Cited

U.S. PATENT DOCUMENTS

| | | | | |
|---|---|---|---|---|
| 2008/0293345 | A1 | 11/2008 | Bright et al. | |
| 2010/0037530 | A1 | 2/2010 | Yoshida et al. | |
| 2015/0059256 | A1* | 3/2015 | Mejean | B24D 3/06 51/309 |
| 2022/0023997 | A1 | 1/2022 | Kyoshima | |

FOREIGN PATENT DOCUMENTS

| | | | |
|---|---|---|---|
| JP | 2008-137126 | A | 6/2008 |
| JP | 2009-034817 | A | 2/2009 |
| JP | 4573492 | B2 | 11/2010 |
| JP | 2013-188816 | A | 9/2013 |
| JP | 2017-047499 | A | 3/2017 |
| JP | 2019-141974 | A | 8/2019 |
| JP | 2019-177452 | A | 10/2019 |
| KR | 101503545 | B1 | 3/2015 |
| TW | 201330977 | A | 8/2013 |

OTHER PUBLICATIONS

Taiwanese Office Action dated Oct. 13, 2023 received in 112118120.
Korean Office Action dated Nov. 13, 2023 received in 10-2023-0080719.
European Search Report dated Feb. 15, 2024 received in 23 17 8151.

* cited by examiner

| | | |
|---|---|---|
| Composition ratio [vol%] | Abrasive grain | 0～20 |
| | Binder | 5～30 |
| | Pores | Remaining |
| | First filler | 0～40 |
| | Second filler | 0～10 |
| | Third filler | 0～20 |

SYNTHETIC GRINDSTONE, SYNTHETIC GRINDSTONE ASSEMBLY, AND MANUFACTURING METHOD OF SYNTHETIC GRINDSTONE

CROSS-REFERENCE TO RELATED APPLICATIONS

This application is based upon and claims the benefit of priority from prior Japanese Patent Application No. 2022-152940, filed Sep. 26, 2022, the entire contents of which are incorporated herein by reference.

FIELD

The present invention relates generally to a synthetic grindstone for performing surface processing, for example, chemo-mechanical grinding (CMG), a synthetic grindstone assembly, and a manufacturing method of the synthetic grindstone.

BACKGROUND

A method of surface processing by dry chemo-mechanical grinding (CMG) may be used (e.g., refer to Japanese Patent No. 4573492). In the CMG process, a synthetic grindstone in which abrasive (abrasive grains) is fixed with resin binder such as a thermoplastic resin is used. Then, the synthetic grindstone is pressed against a wafer while rotating the wafer and the synthetic grindstone (e.g., refer to Patent Application KOKAI Publication No. 2004-87912). Convex portions on the wafer surface are heated and oxidized by friction with the synthetic grindstone, become brittle, and fall off. In this way, only the convex portions of the wafer are ground and planarized.

As the CMG process progresses, the abrasive grains (abrasive) gradually fall off from a surface (polishing action surface) of the binder of the synthetic grindstone with respect to a workpiece, and the polishing action surface of the synthetic grindstone becomes smooth.

SUMMARY

In an aspect of the present invention, a synthetic grindstone for performing surface processing, includes: abrasive grains; binder made of a thermosetting resin material and holding the abrasive grains in a dispersed state; and filler including at least one of first filler, second filler, and third filler. The first filler has a larger average particle diameter than the abrasive grains. The second filler has electrical conductivity. The third filler is harder than a workpiece. The filler is disposed in a state of being dispersed in the binder. An abrasive grain rate (Vg) of the abrasive grains is more than 0 vol % and 20 vol % or less. A binder rate (Vb) of the binder is 5 vol % or more and 30 vol % or less. The first filler is 0 vol % or more and 40 vol % or less. The second filler is 0 vol % or more and 10 vol % or less. The third filler is 0 vol % or more and 20 vol % or less.

DETAILED DESCRIPTION

Figure 1:
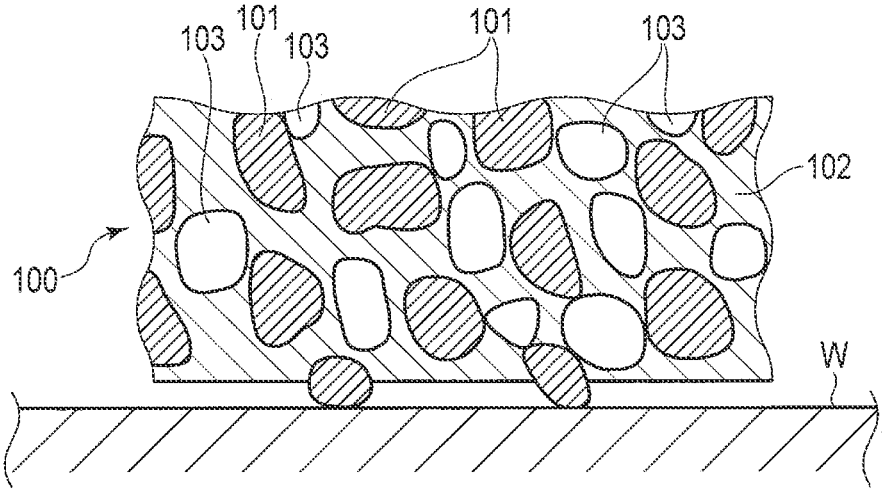
FIG. 1 is a schematic diagram of a structure of a synthetic grindstone according to an embodiment.

As shown in FIG. 1, a synthetic grindstone 100 is formed of abrasive grains (abrasive) 101 and binder 102. The synthetic grindstone 100 may further have pores 103. In the present embodiment, the synthetic grindstone 100 holds the abrasive grains 101 in a dispersed state in the binder 102, and has the pores 103 arranged by being dispersed in the binder 102.

The abrasive grains 101 are not limited to the following, but when the workpiece is silicon, it is preferable to apply, for example, silica, cerium oxide, or a mixture thereof. Similarly, in a case where the workpiece is sapphire, it is preferable to apply chrome oxide, ferric oxide, or a mixture thereof. In addition, alumina, silicon carbide, or a mixture thereof can also be used as an applicable abrasive depending on the kind of workpiece.

In the present embodiment, an example will be described in which the workpiece is silicon, and, for example, cerium oxide having an average particle diameter of approximately 1 μm is used as the abrasive grains 101. The particle diameter of the abrasive grains 101 can be set as appropriate, but is preferably less than 5 μm, for example.

As the binder 102, a thermosetting resin is used in the present embodiment. As an example of the thermosetting resin, phenol resin can be used.

Figure 2:
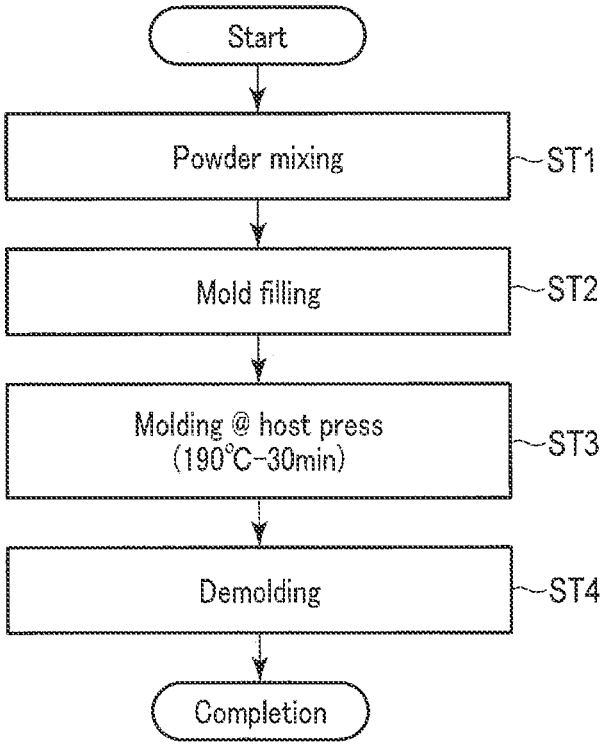
FIG. 2 is a schematic diagram showing a manufacturing flow (manufacturing method) of the synthetic grindstone (molded body).

The synthetic grindstone (molded body) 100 is formed based on a flow (manufacturing method) shown in FIG. 2.

First, the abrasive grains 101 in a volume ratio to be described later and liquid phenol as the binder 102 are mixed to obtain a mixed material (step ST1).

Next, a mold for forming the mixed material into a shape that will become a final shape of the synthetic grindstone 100 is filled with the mixed material (step ST2). For example, liquid phenol is thermally cured by pressure molding (hot press) at 190 degrees for thirty minutes to mold the synthetic grindstone 100 as a molded body (step ST3). Then, the molded body in the mold is demolded (step ST4).

Figures 3, 4:
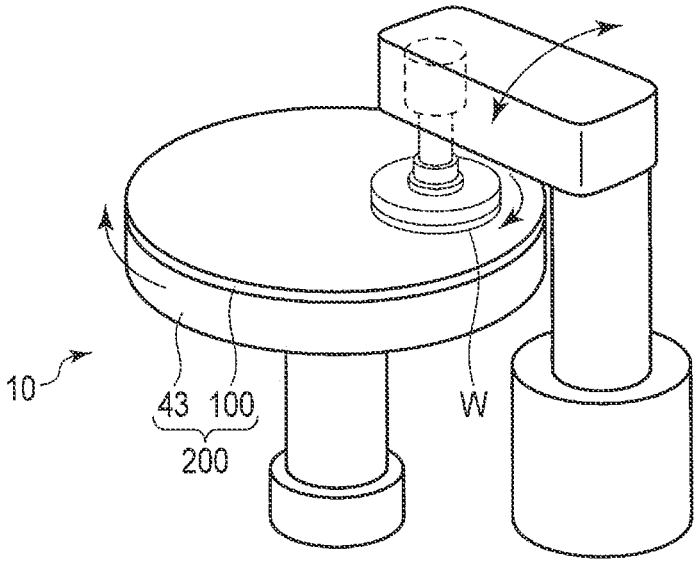
FIG. 3 is a table showing a volume ratio (abrasive grains, binder, filler) of the synthetic grindstone when manufacturing a synthetic grindstone using a thermosetting resin as binder.
FIG. 4 is a schematic diagram showing a CMG device used for processing of a workpiece.

FIG. 3 shows a table of a composition of the synthetic grindstone 100 when manufacturing the synthetic grindstone 100 using a thermosetting resin as the binder 102 as described above.

As shown in FIG. 3, an abrasive grain rate (Vg) of the abrasive grains 101 is more than 0 vol % and 20 vol % or less. A binder rate (Vb) of the binder 102 is 5 vol % or more and 30 vol % or less.

In the present embodiment, the synthetic grindstone 100 is formed in an annular shape, and used for dry chemo-mechanical grinding (CMG) processing for processing through a combined action by a mechanical action and a chemical component. That is, the synthetic grindstone 100 exerts a dry chemo-mechanical grinding action on the surface of the wafer W, which is the workpiece, to perform the surface processing of the wafer W as the workpiece. Then, the synthetic grindstone 100 is fixed to a grindstone holding member (base body) 43 with a double-faced tape, an adhesive, etc. to be formed as a synthetic grindstone assembly 200, and is attached to the CMG device 10 shown in FIG. 4 to be used for the surface processing of the wafer W as the workpiece. It suffices that the grindstone holding member 43 has appropriate rigidity to withstand CMG processing, is heat resistant at temperatures that may increase with use of the synthetic grindstone 100, and does not heat soften, such as an aluminum alloy material.

The synthetic grindstone assembly 200 having the grindstone holding member 43 and the synthetic grindstone 100 and the wafer W as the workpiece are each rotated in an arrow direction in FIG. 4 while the wafer W is pressed against the synthetic grindstone 100. At this time, the synthetic grindstone 100 is rotated at a peripheral speed of, for example, 600 m/min, and the wafer W is pressed with a processing pressure of 300 g/cm$^2$. Thus, the synthetic grindstone 100 and the surface of the wafer W slide against each other. Upon starting of the processing, the synthetic grindstone 100 and the surface of the wafer W slide against each other, and an external force acts on the binder 102. As the CMG process progresses, by the continuous action of the external force, the abrasive grains (abrasive) 101 gradually fall off from a surface (polishing action surface) of the binder 102 of the synthetic grindstone 100 with respect to the surface of the wafer W as the workpiece. Then, the surface of the wafer W is polished by the chemo-mechanical action by the fixed abrasive grains 101 held in the thermosetting resin as the binder 102 or by the abrasive grains 101 fallen off from the surface of the binder 102. Convex portions on the surface of the wafer W are heated and oxidized by friction with the synthetic grindstone 100, become brittle, and fall off. In this way, only the convex portions on the surface of the wafer W are ground, and the surface of the wafer W is planarized.

In the present embodiment, the thermosetting resin is used as the binder 102 instead of using a thermoplastic resin material (e.g., ethyl cellulose) as binder. This allows for a higher melting temperature as compared to a case of using a thermoplastic resin material as binder, and stabilizes the rigidity and mechanical strength of the synthetic grindstone 100 at appropriately high temperatures. Thus, the synthetic grindstone 100 according to the present embodiment has greater dimensional stability at appropriate high temperatures, for example, as compared to the case of using a thermoplastic resin material as binder. Therefore, the synthetic grindstone 100 according to the present embodiment can suppress deformation at the appropriate high temperatures during machining of the workpiece and improve shape accuracy.

In the case where a thermoplastic resin material is used as binder, heat accumulates between the synthetic grindstone and the wafer W, and softens the thermoplastic resin material as binder, resulting in planarization of the synthetic grindstone surface. Upon melting of the thermoplastic resin material as the binder and welding to the surface of the wafer W, known as sticking, grinding resistance of the synthetic grindstone suddenly increases and the frictional heat becomes excessive, which can cause surface roughness and scratching of the wafer W.

In contrast, in the case where thermosetting resin is used as the binder 102, as in the synthetic grindstone 100 according to the present embodiment, even if heat accumulates in the binder 102, the melting point temperature of the binder 102 can be made high enough to suppress planarization of the synthetic grindstone 100 under appropriate temperatures. Thus, even if heat accumulates between the synthetic grindstone 100 and the wafer W, the resin can be prevented from melting. Accordingly, the synthetic grindstone 100 according to the present embodiment can maintain a stable processing property for a longer period of time. Therefore, it is possible to suppress the occurrence of unintentional scratches on the surface of the wafer W as the workpiece.

This is due to the fact that the inventor of the present invention, in his diligent efforts to improve the excessive frictional heat in dry polishing processing, found that by forming the synthetic grindstone 100 to meet the volume ratio described above, it is possible to achieve excellent workability for the workpiece. That is, the synthetic grindstone 100 suitable for dry surface processing, for example, includes the abrasive grains 101 with an abrasive grain rate (Vg) greater than 0 vol % and 20 vol % or less, and the binder 102 made of a thermosetting resin material with a binder rate (Vb) of 5 vol % or more and 30 vol % or less. A porosity (Vp) is set according to the values of the abrasive grain rate (Vg) and the binder rate (Vb) so as to be 100 vol % together.

According to the present embodiment, it is possible to provide a synthetic grindstone 100, a synthetic grindstone assembly 200, and a manufacturing method of the synthetic grindstone 100, that can suppress excessive frictional heat, for example, when performing dry polishing processing.

In the present embodiment, an example has been described in which the synthetic grindstone 100 is provided in a discoidal shape. The synthetic grindstone 100 can be formed in various kinds of shapes, such as a pellet shape and an elongated rectangular-parallelepiped shape. The synthetic grindstone assembly 200 is formed in an appropriate shape to hold the synthetic grindstone 100.

By using a thermosetting resin material as the binder 102, the synthetic grindstone 100 described in the present embodiment is generally more rigid than synthetic grindstones that use a thermoplastic resin material as binder, and less rigid than synthetic grindstones that use a vitrified bond as binder. This allows an optimal synthetic grindstone to be chosen from the synthetic grindstone 100 that uses a thermosetting resin material as the binder 102, a synthetic grindstone that uses a conventional thermoplastic resin material as binder, and a synthetic grindstone that uses a conventional vitrified bond as binder, to suit the material of the workpiece. That is, the synthetic grindstone 100 according to the present embodiment allows for a wider range of options for the workpiece. For example, there has been a need for users to use synthetic grindstones that have greater rigidity than synthetic grindstones that use a thermoplastic resin material as binder and less rigidity than synthetic grindstones that use vitrified bond as binder. Such needs can be served by using the synthetic grindstone 100 according to the present embodiment.

The synthetic grindstone 100 according to the present embodiment has been described in the example of using dry machining, but it can also be used in, for example, wet machining using grinding water (e.g., pure water).

In the present embodiment, the example of using phenol resin as the thermosetting resin material used for the binder 102 has been described. For example, epoxy resin, melamine resin, rigid urethane resin, urea resin, unsaturated polyester resin, alkyd resin, polyimide resin, polyvinyl acetal resin, etc. can be used as thermosetting resin materials for the binder 102. These resin materials may be used in combination as appropriate. These cured thermosetting resin materials have excellent water resistance, chemical resistance, and heat resistance, as well as moderate hardness and excellent shape and dimensional stability during use.

(First Modification)

The synthetic grindstone 100 according to the present modification will be described for a case where coarse particles of an appropriate size are included as the first filler.

Each of shapes of the first filler is preferably, but not necessarily limited to, a spherical shape, and may include some unevenness and deformation as long as it is an aggregate. The first filler is silica, for example, and is dispersed and fixed by the binder 102 made of a thermosetting resin material. It is preferable for the first filler to include silica with a particle diameter larger than the particle diameter of the abrasive grains 101 and smaller particle diameter silica that is fixed around the larger particle diameter silica. The smaller particle diameter silica is preferably smaller in particle diameter than the abrasive grains 101. A volume ratio of the first filler in the synthetic grindstone 100 is set according to a correlation with the abrasive grain rate (Vg) of the abrasive grains 101, for example, based on the binder rate (Vb) of the binder 102. The first filler is preferably more than 0 vol % and 40 vol % or less.

With respect to the wafer W as a silicon workpiece, the abrasive grains 101 made of cerium oxide is as hard as or softer than the wafer W or its oxide. With respect to the abrasive grains 101, the first filler made of silica is as hard as or softer than the wafer W or its oxide.

The synthetic grindstone 100 containing the abrasive grains 101, the binder 102 made of a thermosetting resin material, and the first filler is manufactured as described in the above embodiment.

Since an average particle diameter of the first filler is larger than that of the abrasive grains 101, the synthetic grindstone 100 and the wafer W during processing almost come into contact with each other via an apex of the first filler. That is, since the first filler is present between the base material (the abrasive grains 101 and the binder 102 made of a thermosetting resin material) of the synthetic grindstone 100 and the wafer W, the base material and the wafer W are not in direct contact with each other, and a constant space is formed therebetween.

Upon starting of processing in a state in which the first filler is in contact with the wafer W, an external force acts on the base material. By this external force continuously acting, the abrasive grains 101 falls off from the base material. The released abrasive grains 101 is present at a processing interface in a state of being adhered to the first filler in the space between the synthetic grindstone 100 and the wafer W. Thus, the abrasive grains 101 and the wafer W during processing almost come into contact with each other via the apex of the first filler. As a result, an actual contact area between the abrasive grains 101 and the wafer W is greatly reduced, and a working pressure at a processing point is increased. Therefore, the grinding process proceeds with a high processing efficiency.

Circulation of the air near the surface of the wafer W with the outside air is promoted by the space, and the processing surface is cooled. In addition, sludge generated by the abrasive grains 101 is discharged from the wafer W to the outside through the space, so that the surface of the wafer W can be prevented from being damaged. As a result, burning and scratching on the surface of the wafer W due to frictional heat can be prevented.

In this way, the surface of the wafer W is ground flat and to a predetermined surface roughness by the synthetic grindstone 100.

According to the synthetic grindstone 100 of the present modification, even if the processing proceeds, the contact pressure between the abrasive grains 101 and the wafer W is sufficiently maintained to maintain the processing efficiency, and the direct contact between the binder 102 and the wafer W is suppressed, so that quality deterioration and scratching of the wafer W can be prevented. In the present modification, it is possible to suppress excessive frictional heat due to the heat generated between the synthetic grindstone 100 and the workpiece, as described in the above embodiment.

As the first filler, silica, carbon, silica gel which is a porous body thereof, activated carbon, spherical resin, etc. are applicable. Hollow balloons used as pore-forming agents are not suitable because they break during processing and cause scratches.

(Second Modification)

A case will be described in which the synthetic grindstone 100 according to the present modification contains, as second filler, a conductive material that is smaller than the first filler described in the first modification and that has an appropriate size. The grindstone holding member 43 of the CMG device 10 described above is described in the present modification as a material having electrical conductivity and appropriate thermal conductivity, for example, an aluminum alloy material.

Examples of the conductive material include carbon nanotubes, etc. These materials are smaller in particle diameter than the average particle diameter of the abrasive grains 101. A volume ratio of the second filler in the synthetic grindstone 100 is set, for example, based on the binder rate (Vb) of the binder 102, in correlation with the abrasive grain rate (Vg) of the abrasive grains 101. It is preferable for the second filler to be added at more than 0 vol % and not more than 10 vol %.

Further, the second filler can improve the strength of the synthetic grindstone 100 as a structure by, for example, using carbon nanotubes, etc.

Upon start of the processing of the wafer W at the CMG device 10, the synthetic grindstone 100 and the wafer W slide against each other, and an external force acts on the binder 102. By a continuous action of the external force, the abrasive grains 101 falls off onto the wafer W. The released abrasive grains 101 slides in a space between the synthetic grindstone 100 and the wafer W. By the chemo-mechanical action of the abrasive grains 101, the surface of the wafer W is polished.

Upon polishing of the surface of wafer W and an occurrence of friction, static electricity can be generated on the surface of the wafer W. At this time, the conductive second filler conducts static electricity from the surface of the wafer W to the grindstone holding member 43 (refer to FIG. 4). Accordingly, by using the synthetic grindstone 100 according to the present modification, the static electricity generated on the surface of the wafer W can be removed while polishing the surface of the wafer W. As a result, dust, etc. can be prevented from adhering to the surface of the wafer W.

Further, in the present modification, the thermal conductivity of the grindstone holding member 43 is higher than that of the synthetic grindstone 100. Upon polishing of the surface of the wafer W and an occurrence of friction, frictional heat is generated on the surface of the wafer W. At this time, the second filler absorbs the frictional heat, and the heat absorbed by the second filler is heat-conducted to the grindstone holding member 43. Accordingly, by using the synthetic grindstone 100 according to the present modification, the frictional heat generated on the surface of the wafer W can be removed while polishing the surface of the wafer W. As a result, burning and scratching on the surface of the wafer W due to the frictional heat between the surface of the synthetic grindstone 100 and the surface of the wafer W can be prevented. Therefore, the synthetic grindstone 100 according to the present modification can not only process the surface of the wafer W well, but also extend the service life of the synthetic grindstone 100.

It is also preferable to provide a heat dissipation portion such as a heat dissipation fin in the grindstone holding member 43 that rotates together with the synthetic grindstone 100, i.e., it is also preferable that the synthetic grindstone assembly 200 have a heat dissipation portion (heat transmission portion). In this case, rotation brings the heat dissipation portion into contact with the air, effectively dissipating heat from the synthetic grindstone 100.

It is also possible to cool the grindstone holding member 43 and the synthetic grindstone 100 by installing water pipes for cooling water or the like inside the grindstone holding member 43.

In the present modification, the example of the grindstone holding member 43 having electrical conductivity and higher thermal conductivity than that of the synthetic grindstone 100 has been described, but it may be formed of a material having at least one of electrical conductivity or higher thermal conductivity than that of the synthetic grindstone 100. In the case of having the electrical conductivity, static electricity between the workpiece and the synthetic grindstone 100 can be removed, and in the case of having the higher thermal conductivity than that of the synthetic grindstone 100, heat that can be generated in the synthetic grindstone 100 can be effectively dissipated.

The first modification describes the example in which the first filler is used, and the second modification describes the example in which the second filler is used. The synthetic grindstone 100 preferably includes both of the first filler and the second filler. In this case, the abrasive rate of the abrasive grains 101 is, for example, 2.5 vol %, the binder rate of the binder 102 is, for example, 22 vol %, the porosity of the pores 103 is, for example, 48%, the first filler is 25 vol %, and the second filler is 2.5 vol %. In this case as well, the synthetic grindstone 100 also determines the binder rate (Vb) of the binder 102 first, and then the abrasive grain rate (Vb) of the abrasive grains 101 and the volume ratios of the first filler and the second filler are set according to the correlation of the abrasive grains 101, first filler, and second filler.

(Third Modification)

A case will be described in which the synthetic grindstone 100 according to the present modification contains, as a third filler, particles that are smaller than the first filler described in the first modification and that have an appropriate size.

Examples of the particles of the third filler include green carborundum (GC), etc. These particles are harder than the wafer W as the workpiece. The particles of the third filler, such as GC, may be larger or smaller than the average particle diameter of the abrasive grains 101. As a matter of course, the particles of GC, etc. may be as large as the average particle diameter of the abrasive grains 101.

For example, the average particle diameter of the metal oxide-based abrasive grains 101, such as aluminum oxide (alumina), zirconium oxide (zirconia), cerium oxide (ceria), and silicon oxide (silica), can be larger, smaller, or of similar size than GC. For example, the average particle diameter of the alumina, zirconia, and ceria-based abrasive grains 101 is almost always larger than GC. For example, the average particle diameter of the alumina-based abrasive grains 101 can be as large as GC (~200 nm). For example, if a particle of GC, etc. is 10 nm, the average particle diameter of the abrasive grains 101 such as silica may be 1 nm.

A volume ratio of the third filler in the synthetic grindstone 100 is set according to a correlation with the abrasive grain rate (Vg) of the abrasive grains 101, for example, based on the binder rate (Vb) of the binder 102. The third filler is preferably added at more than 0 vol % and 20 vol % or less.

There is a technique (gettering effect) in which a gettering site such as a fine scratch is formed on the back surface of the wafer W opposite to the front surface, and impurities are captured by the gettering site. GC is harder than the back surface of the wafer W and is used to intentionally scratch the back surface of the wafer W.

In the present modification, as described in the above embodiment, it is possible to suppress frictional heat from becoming excessive due to heat generated between the synthetic grindstone 100 and the workpiece. If the GC is conductive, it can also suppress static electricity that can be generated between the synthetic grindstone 100 and the workpiece.

The first modification has described an example in which the first filler is used, and the second modification has described an example in which the second filler is used. It is also preferable for the synthetic grindstone 100 to contain two or three of the first filler, the second filler, and the third filler. In the case where three are included, it is preferable that the abrasive rate of the abrasive grains 101 is, for example, more than 0 vol % and 20 vol % or less, the binder rate is 5 vol % or more and 30 vol % or less, the first filler is more than 0 vol % and 40 vol % or less, the second filler is more than 0 vol % and 10 vol % or less, and the third filler is more than 0 vol % and 10 vol % or less. The second filler and the third filler together are preferably more than 0 vol % and 20 vol % or less. If the synthetic grindstone 100 contains the second filler and the third filler, the second filler is preferably 10 vol % or less.

Additional advantages and modifications will readily occur to those skilled in the art. Therefore, the disclosure in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A synthetic grindstone for performing surface processing used for dry chemo-mechanical grinding (CMG) processing or without liquid or slurry, the synthetic grindstone comprising:

abrasive grains;

a binder made of a thermosetting resin material and holding the abrasive grains in a dispersed state; and a filler including at least one of a first filler having a larger average particle diameter than the abrasive grains, a second filler having electrical conductivity, and a third filler harder than a workpiece, the filler being disposed in a state of being dispersed in the binder;

wherein:

an abrasive grain ratio (Vg) of the abrasive grains to a total composition of the synthetic grindstone is more than 0 vol % and 20 vol % or less, a binder ratio (Vb) of the binder to the total composition of the synthetic grindstone is 5 vol % or more and 30 vol % or less, the first filler is greater than 0 vol % and 40 vol % or less, the second filler is greater than 0 vol % and 10 vol % or less, and the third filler is greater than 0 vol % and 20 vol % or less.

2. A synthetic grindstone assembly comprising:

the synthetic grindstone according to claim 1; and a base body to which the synthetic grindstone is fixed, the base body having at least one of electrical conductivity and thermal conductivity higher than a thermal conductivity of the synthetic grindstone.

3. A synthetic grindstone for performing surface processing used for dry chemo-mechanical grinding (CMG) processing or without liquid or slurry, the synthetic grindstone comprising:

abrasive grains;

a binder made of a thermosetting resin material and holding the abrasive grains in a dispersed state; and a plurality of carbon nanotubes as a filler having an electrical conductivity, the carbon nanotubes being disposed in a state of being dispersed in the binder.

4. The synthetic grindstone according to claim 3, wherein:

an abrasive grain ratio (Vg) of the abrasive grains is greater than 0 vol % and 20 vol % or less, a binder ratio (Vb) of the binder is greater than 5 vol % and 30 vol % or less, and the carbon nanotubes are greater than 0 vol % and 10 vol % or less.

5. A synthetic grindstone assembly comprising:

the synthetic grindstone according to claim 3; and a base body to which the synthetic grindstone is fixed, the base body having at least one of electrical conductivity and thermal conductivity higher than a thermal conductivity of the synthetic grindstone.

6. A manufacturing method of the synthetic grindstone for performing surface processing used for dry chemo-mechanical grinding (CMG) processing or without liquid or slurry, the method comprising:

mixing:

abrasive grains with the abrasive grain ratio (Vg) of the abrasive grains to a total composition of the synthetic grindstone being greater than 0 vol % and 20 vol % or less, a binder made of a thermosetting resin material, the binder with the binder ratio (Vb) of the binder to a total composition of the synthetic grindstone being greater than 5 vol % and 30 vol % or less, and a filler to obtain a mixed material;

filling a mold with the mixed material;

molding by hot press, the abrasive grains and the filler being disposed in a state of being dispersed in the binder; and demolding a molded body, wherein:

the filler including at least one of a first filler having a larger average particle diameter than the abrasive grains, a second filler having electrical conductivity, and a third filler harder than a workpiece, the first filler is greater than 0 vol % and 40 vol % or less, the second filler is greater than 0 vol % and 10 vol % or less, and the third filler is greater than 0 vol % and 20 vol % or less.

* * * * *